US011035188B2

(12) United States Patent
Morland

(10) Patent No.: US 11,035,188 B2
(45) Date of Patent: Jun. 15, 2021

(54) ANCHOR MODULE FOR ANCHORING TO A CASING, A CASING PLUG ASSEMBLY AND A METHOD FOR SETTING TWO CASING PLUGS IN ONE RUN

(71) Applicant: Interwell Norway AS, Hafrsfjord (NO)

(72) Inventor: Markus Morland, Trondheim (NO)

(73) Assignee: Interwell Norway AS, Hafrsfjord (NO)

( * ) Notice: Subject to any disclaimer, the term of this patent is extended or adjusted under 35 U.S.C. 154(b) by 0 days.

(21) Appl. No.: 16/494,481

(22) PCT Filed: Jan. 9, 2018

(86) PCT No.: PCT/EP2018/050418

§ 371 (c)(1),
(2) Date: Sep. 16, 2019

(87) PCT Pub. No.: WO2018/184742

PCT Pub. Date: Oct. 11, 2018

(65) Prior Publication Data

US 2020/0088001 A1 Mar. 19, 2020

(30) Foreign Application Priority Data

Apr. 7, 2017 (NO) ..... 20170594

(51) Int. Cl.
*E21B 23/01* (2006.01)
*E21B 33/128* (2006.01)
(Continued)

(52) U.S. Cl.
CPC ..... *E21B 23/01* (2013.01); *E21B 23/04* (2013.01); *E21B 33/1285* (2013.01);
(Continued)

(58) Field of Classification Search
CPC ..... E21B 23/01; E21B 23/04; E21B 33/1285; E21B 33/1293; E21B 33/1295; E21B 33/134; E21B 33/128; E21B 33/129
See application file for complete search history.

(56) References Cited

U.S. PATENT DOCUMENTS 3,426,846 A 2/1969 Young
4,133,386 A * 1/1979 Knox ..... E21B 33/127 166/120
(Continued)

FOREIGN PATENT DOCUMENTS

GB 846859 A 8/1960
GB 2411674 A 9/2005
(Continued)

OTHER PUBLICATIONS

Norwegian Search Report issued in counterpart Norwegian Patent Application No. 20170594, dated Nov. 3, 2017 (2 Pages).
(Continued)

*Primary Examiner* — Tara Schimpf
*Assistant Examiner* — Jonathan Malikasim
(74) *Attorney, Agent, or Firm* — Osha Bergman Watanabe & Burton LLP

(57) ABSTRACT

An anchor module has an inner mandrel having a through bore, a slips device, upper and lower slips supports, and a spring device radially outside of the inner mandrel. The slips device is biased to a run state. A fluid actuation system counteracts the biasing force and includes a lower piston axially displaceable within a lower fluid chamber, an upper piston axially displaceable within an upper fluid chamber, and a fluid restriction provided in the bore. A lower fluid line is provided between the bore and the lower fluid chamber. The upper and lower pistons are connected to the lower slips device. An upper fluid line is between the bore and the upper fluid chamber. A cross sectional area of the fluid bore at the entrance of the upper fluid line smaller than the cross sectional area of the fluid bore at the entrance of the lower fluid line.

19 Claims, 5 Drawing Sheets

(51) Int. Cl.

| | |
|---|---|
| ***E21B 33/129*** | (2006.01) |
| ***E21B 33/1295*** | (2006.01) |
| ***E21B 33/134*** | (2006.01) |
| ***E21B 23/04*** | (2006.01) |

(52) U.S. Cl.
CPC ..... *E21B 33/1293* (2013.01); *E21B 33/1295* (2013.01); *E21B 33/134* (2013.01)

(56) References Cited

U.S. PATENT DOCUMENTS

| | | | | | |
|---|---|---|---|---|---|
| 4,577,695 | A * | 3/1986 | Wood | E21B 33/1243 | 166/187 |
| 5,070,941 | A * | 12/1991 | Kilgore | E21B 23/04 | 166/98 |
| 6,131,663 | A * | 10/2000 | Henley | E21B 23/006 | 166/373 |
| 8,807,215 | B2 * | 8/2014 | Holderman | E21B 34/08 | 166/269 |
| 9,725,980 | B2 * | 8/2017 | Hallundbæk | E21B 23/06 | |
| 2004/0055755 | A1 | 3/2004 | Roesner et al. | | |
| 2013/0299160 | A1 | 11/2013 | Lott | | |

FOREIGN PATENT DOCUMENTS

| | | | |
|---|---|---|---|
| NO | 20150683 | A1 | 11/2016 |
| WO | 03/036028 | A2 | 5/2003 |
| WO | 2016/189123 | A2 | 12/2016 |

OTHER PUBLICATIONS

International Search Report issued in PCT/EP2018/050418 dated Mar. 31, 2018 (2 pages).
Written Opinion of the International Searching Authority issued in PCT/EP2018/050418 dated Mar. 21, 2018 (9 Pages).

* cited by examiner

Fig. 1: Prior art

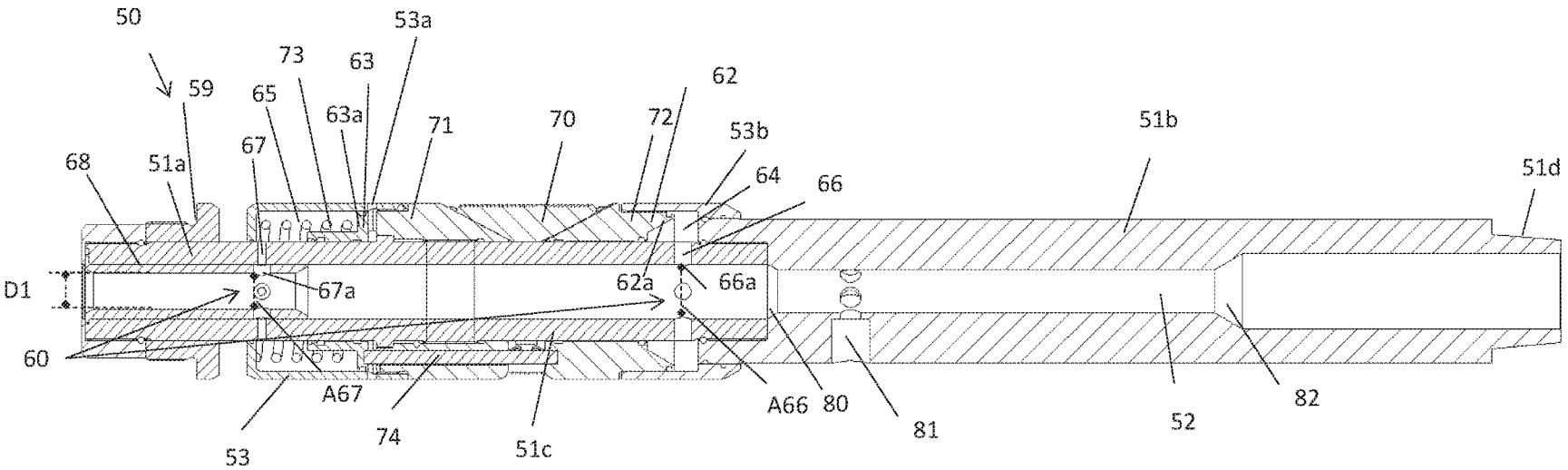
Fig. 3: Upper anchor module – run state
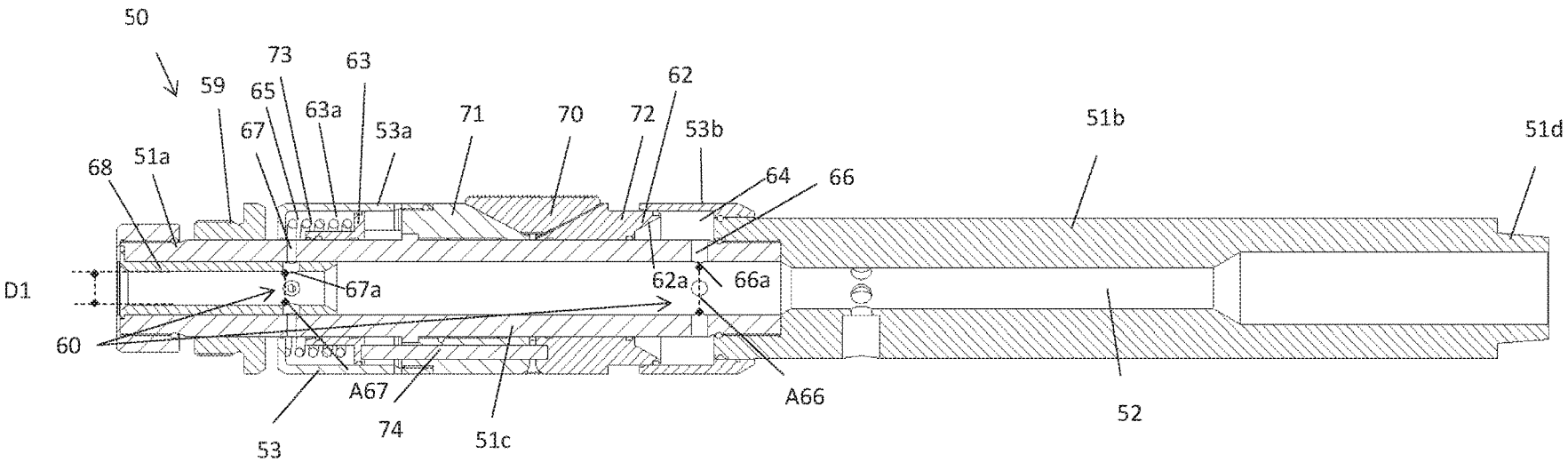
Fig. 4: Upper anchor module – set state

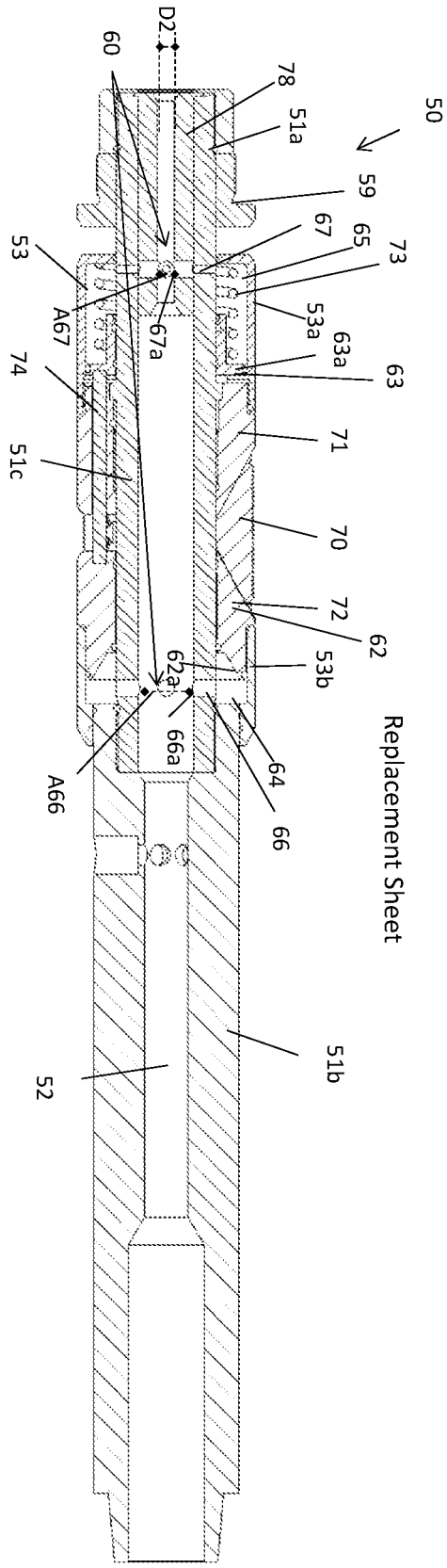
Fig. 5: Lower anchor module – run state
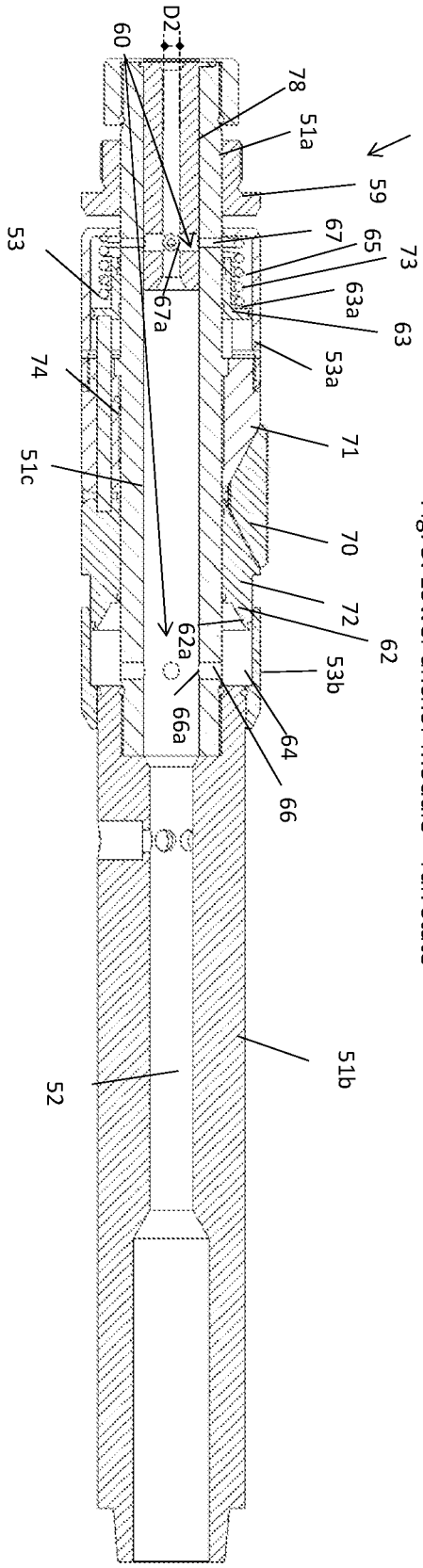
Fig. 6: Lower anchor module – set state
Replacement Sheet

ANCHOR MODULE FOR ANCHORING TO A CASING, A CASING PLUG ASSEMBLY AND A METHOD FOR SETTING TWO CASING PLUGS IN ONE RUN

TECHNICAL FIELD

The present invention relates to an anchor module for anchoring to a casing, a casing plug assembly and a method for setting two casing plugs in one run.

BACKGROUND OF THE INVENTION

There are different types of well plugs used in hydrocarbon producing wells. Such plugs may be retrievable plugs, i.e. they may be retrieved from the well after their use, or they may be permanent plugs, i.e. they are set permanently and must be milled/drilled into pieces in order to be removed.

The well plug may comprise an anchor device, which in the set state (radially expanded state) is in contact with the inner surface of the well pipe. Its primary object is to prevent upwardly and/or downwardly directed movement of the plug in relation to the well pipe.

The well plug may also comprise a sealing device, which in the set state (radially expanded state) also is in contact with the inner surface of the well pipe. Its primary object is to prevent fluid to pass the annular space between the outer surface of the plug and the inner surface of the well pipe.

Plugs are set by means of a running tool lowered into the well. The running tool is connected to the plug, and at the desired depth, the running tool is actuated and the plug is brought from its run state (radially retracted state) to its set state (radially expanded state).

One common connection interface between a plug and a running tool comprises an inner mandrel of the plug connected to an inner mandrel of the running tool and an outer housing of the plug connected to an outer housing of the running tool. By relative axial movement between the outer housing and the inner mandrel, the plug is brought from its run state to its set state. In order to initiate this relative movement, an axial force larger than a certain threshold is applied to the inner mandrel while holding the outer housing stationary (or vice versa). At this force threshold, a shear stud is sheared off, and consequently relative axial movement is allowed. The shear stud may be located in the plug or in the running tool.

One object of the present invention is to achieve a well plug where the setting of the plug is not initiated by the above relative movement between an inner mandrel and an outer housing.

Casing plugs are one type of well plug used during completion of a hydrocarbon well, during temporary plugging and abandonment (P&A) of the well etc. The casing plug is set in the casing pipe by using drill pipe to run the plug, to set the plug and also to retrieve the plug. The casing plug preferably should have some capabilities:

- it should be possible to hang off weight under the plug such as drill pipe, bottom hole assembly, sensors, etc.
- it should be possible to pump fluid through the plug before an equalizing valve is closed, in order to check the pressure under the plug, for example to check that the completion operation was successful.
- the plug should be resettable, e.g. it should be possible to run the plug to a desired position, then set the plug and perform a pressure test, then to run the plug to a new desired position, set the plug again and then perform a pressure test again.
- it should be possible to abandon the plug in a set and closed state, i.e. to retrieve the running tool and drill pipe after the setting and closing of the plug.

Typically, such setting and resetting of the plug have been actuated by rotation of the drill pipe. A disadvantage is that it is difficult to ascertain how much the lower part of the drill string has rotated in relation to how much the upper part of the drill string has rotated, particularly for long drill strings. Another disadvantage is that there is a risk that one of the joints of drill pipe will be unscrewed, instead of bringing the plug to the desired state.

Consequently, it is an object of the present invention to achieve a casing plug which has the above capabilities while avoiding the disadvantages of the rotating drill pipe.

Another known way of initiating the setting operation of the plug has been to use so-called drag blocks to create friction between the plug and the inner surface of the casing. Such drag-blocks are typically connected to the plug via coil springs, allowing the drag-blocks to move in relation to the plug due to irregularities of the inner surface of the casing etc. The friction is however sufficient to form an initial anchor which keeps some parts of the plug stationary while moving other parts by means of the pipe string. One example is shown in U.S. Pat. No. 3,714,383.

One known way of achieving fluid actuated plugs is to provide the plug with a closed compartment at the surface. When the plug is lowered into the well, the pressure of the fluid in the annulus outside the plug is typically much higher than the pressure within the closed compartment. Hence, by opening a passage between the annulus and the compartment, fluid will flow from the annulus and into the compartment—a fluid flow that may be used to bring at least parts of the plug from the run state to the set state. An initial operation is here always needed to open the passage at the desired location in the well. One example is shown in U.S. Pat. No. 3,294,171.

Here, the opening of the passage is initiated by detent means which are moved upwards into engagement with a joint or other obstruction provided in the inner surface of the casing itself. Moreover, this solution also requires shear pins.

Hence, in the above two solutions, a first, initial contact between the plug and the casing is needed in order to achieve a second contact in the form of a proper anchoring of the plug to the casing. Moreover, the two solutions above are irreversible (opening of the passage to the atmospheric compartment and the breaking of shear pins).

It is an object of the invention to provide an improved initial anchoring of the casing plug to the casing—without the use of drag blocks and/or gas filled compartment of the above prior art.

One plugging device which solves the above problems is the Interwell SSCP plug (Straight Set Casing Plug) described in the Norwegian patent application NO 20150683. One object of the present invention is to provide an improved such plug, where it is possible to connect two such plugs on one drill pipe assembly, and where it is possible to set those two plugs in one run. This will reduce the time needed to set two such plugs. Two such plugs are needed to provide a double barrier in the well—a security requirement needed in the well until the blowout preventer is installed on the well head. This is not possible with the present SSCP plug, as two separate runs are required.

Another disadvantage of the Interwell SSCP plug is that the setting operation is dependent of the pressure differential between the outside and inside of the plug. The pressure inside the plug is the combined backpressure generated by the restriction and any pipe or equipment suspended underneath the plug. For example, if no equipment is suspended underneath, the backpressure for any given flowrate is lower, and activation will require a higher flowrate. If pipe or other equipment is suspended underneath, this equipment will generate a higher backpressure requiring a lower flow rate for activation. As such, the fluid flow required to generate sufficient pressure will vary with application. One object of the invention is to eliminate backpressure's effects on the activation, ensuring that the anchor module activates at the correct flow rate.

One object is also to provide a method for setting two casing plugs of a drill pipe assembly in one run.

One object is also to provide a method for retrieving two casing plugs with a drill pipe assembly in one run.

SUMMARY OF THE INVENTION

The present invention relates to an anchor module for anchoring to a casing, comprising:

an inner mandrel having a through bore;

a slips device provided radially outside the inner mandrel;

upper and lower slips supports for supporting the slips device in a run state, in which the slips device is radially retracted, and for supporting the slips device in a set state, in which the slips device is radially expanded;

a spring device provided radially outside of the inner mandrel, where the slips device is biased to its run state by means of the spring device;

a fluid actuation system configured to counteract the biasing force provided by the spring device, thereby causing the slips device to move from its run state to its set state;

where the fluid actuation system comprises a lower piston axially displaceable within a lower fluid chamber, where a lower fluid line is provided between the bore and the lower fluid chamber, where the lower piston is a part of or is connected to the lower slips device;

characterized in that:

the fluid actuation system further comprises an upper piston axially displaceable within an upper fluid chamber, where an upper fluid line is provided between the bore and the upper fluid chamber, where the upper piston is connected to the lower slips device;

the fluid actuation system further comprises a fluid restriction provided in the bore, where a cross sectional area of the fluid bore at the entrance of the upper fluid line is smaller than the cross sectional area of the fluid bore at the entrance of the lower fluid line.

The casing may here be a casing pipe, a production tubing or another type of cylindrical pipe used in a hydrocarbon well.

In one aspect the anchor module comprises an outer housing comprising a lower housing section and an upper housing section provided radially outside at least a section of the inner mandrel, where the lower fluid chamber is provided inside the lower housing section and where the upper fluid chamber is provided inside the upper housing section.

In one aspect the spring device is provided in the upper fluid chamber.

In one aspect the upper piston is connected to the lower slips device by means of an axial rod.

In one aspect the area of a lower piston surface of the lower piston is equal to the area of an upper piston surface of the upper piston.

In one aspect the fluid actuation system is configured to be supplied with a fluid via the bore.

In one aspect the lower piston surface of the lower piston is a part of the lower slips device.

The present invention also relates to a casing plug assembly for providing a double barrier in a casing, comprising:

an upper drill pipe section;

a upper casing plug connected below the upper drill pipe section;

where the upper casing plug comprises a upper running module, an upper seal module and a upper anchor module;

where a continuous through bore is provided through the upper drill pipe section and the upper casing plug;

where the upper anchor module is configured to be set in the casing by pumping a fluid at a first fluid rate through the bore;

characterized in that the casing plug assembly further comprises:

an intermediate drill pipe section connected below the upper casing plug;

a lower casing plug connected below the intermediate drill pipe section;

where the lower casing plug comprises a lower running module, a lower seal module and a lower anchor module;

where the continuous through bore is provided through the intermediate drill pipe section and the lower casing plug;

where the lower anchor module is configured to be set in the casing by pumping a fluid at a second fluid rate through the bore;

where the second fluid rate is less than the first fluid rate.

In one aspect, the upper anchor module is an anchor module described above, where the fluid restriction of the upper anchor module has a first diameter;

the lower anchor module is an anchor module described above, where the fluid restriction of the lower anchor module has a second diameter;

the second diameter is smaller than the first diameter.

In one aspect, the lower casing plug is configured to be released from the intermediate drill pipe section before the upper casing plug is set.

The present invention also relates to a method for providing a double barrier in a casing, comprising the steps of:

a) running a casing plug as described above to a desired location in the casing by means of a drill string connected to the upper drill pipe section of the assembly;

b) pumping a fluid through the drill string and the through bore of the assembly at a first fluid rate sufficient to set the lower anchor module in the casing;

c) setting the lower seal module in the casing by applying an axial force to the drill string against the set lower anchor module;

d) disconnecting the lower casing plug from the intermediate drill pipe section of the assembly;

e) moving the upper casing plug to another desired location in the casing;

f) pumping a fluid through the drill string and the through bore of the assembly at a second fluid rate sufficient to set the upper anchor module in the casing;

c) setting the upper seal module in the casing by applying an axial force to the drill string against the set upper anchor module;

d) disconnecting the upper casing plug from the upper drill pipe section from the assembly.

DETAILED DESCRIPTION

Embodiments of the invention will be described in detail with reference to the enclosed drawings, where:

FIG. 3 illustrates the upper anchor module of the upper casing plug of FIG. 2 in the run state;

FIG. 4 illustrates the upper anchor module of FIG. 3 in the set state;

FIG. 5 illustrates the lower anchor module of a lower casing plug of the casing plug assembly in the run state;

FIG. 6 illustrates the lower anchor module of FIG. 5 in the set state;

FIG. 7*a*-7*e* illustrates the casing plug assembly and the steps of a method for setting two casing plugs of such a casing plug assembly.

The present invention is related to devices, assemblies and methods used for different purposes in wells, such as hydrocarbon producing wells. It should be mentioned that the term "lower" and "lower side" is used herein to describe the side being farthest away from the topside of the well, while the term "upper" and "upper side" is used herein to describe the side being closest to the topside of the well.

Figure 1:
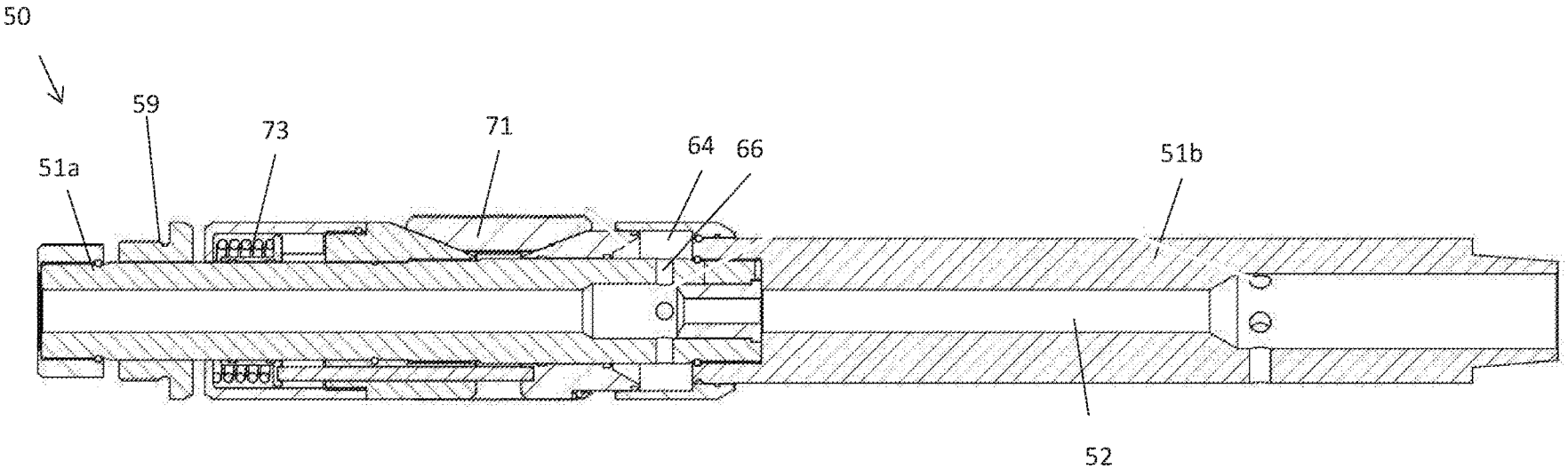
FIG. 1 illustrates an anchor module of a prior art casing plug.

Initially, it is referred to FIG. 1, where a prior art anchor module 50 is shown. The anchor module 50 is known from the Interwell SSCP plug (Straight Set Casing Plug) described in the Norwegian patent application NO 20150683.

Figure 2:
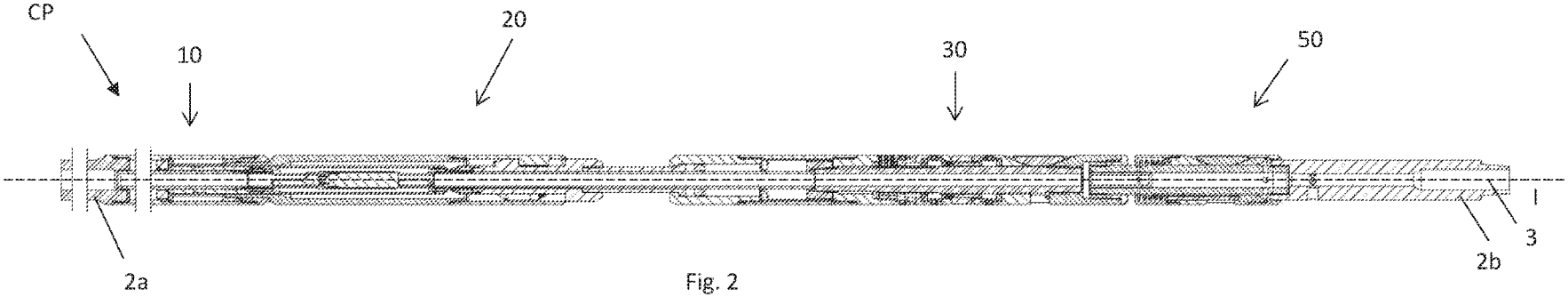
FIG. 2 illustrates an upper casing plug of a casing plug assembly.

In FIG. 2, a casing plug CP is shown. The casing plug CP comprises a running module 10, an equalizing module 20, a seal module 30 and an anchor module 50. Moreover, the casing plug CP comprises an upper connection interface 2*a* for connection to the lower end of a upper drill pipe section and a lower connection interface 2*b* for connection to an upper end of a lower drill pipe section. A through bore 3 is provided through the casing plug CP from its upper end to its lower end for transferring fluid through the casing plug CP, preferably from the uppermost side of the casing plug to the lowermost side of the casing plug.

In the description below, the terms "axial" and "axial direction" refers to the direction of a longitudinal axis 1 of the casing plug.

It should be noted that the modules 10, 20, 30 are known from the interwell SSCP plug and NO 20150683. Therefore, NO 20150683 is incorporated herein by reference for the description of the design and function of these modules. In NO 20150683, the casing plug CP comprises an anchor module 50 identical to or similar to the one shown in FIG. 1. However, the anchor module 50 of FIG. 2 will be described more in detail below.

It should also be noted that in NO 20150683, it is described that the equalizing module 20 of the casing plug CP has the capability of closing the bore 3 and opening the bore 3 again after closing. The equalizing module is initially open to allow fluid to flow through the casing plug to initiate the setting of the anchor module, and is thereafter closed after setting and disconnection of the setting tool. Before retrieval, the equalizing module is opened again, to equalize the pressure below and above the plug, an operation normally performed before retrieval of well plugs.

The seal module 30 has the capability to expand a seal radially out towards the well pipe or casing, thereby preventing axial fluid flow in the annular space between the casing plug and the well pipe or casing.

The running module 10 is a connection interface between the drill pipe and the casing plug.

The anchor module 50 will now be described with reference to FIGS. 3 and 4. The purpose of the anchor module 50 is to provide an anchoring to a casing C (shown in FIG. 7*a*). The casing C is typically a casing pipe or another type of well pipe of the hydrocarbon producing well. The anchor module 50 comprises an inner mandrel 51 and an outer housing 53.

The inner mandrel 51 has a through bore 52, which is a part of the through bore 3 of the casing plug CP. The inner mandrel comprises an upper mandrel section 51*a*, a lower mandrel section 51*b* and an intermediate mandrel section 51*c* provided axially between the upper and lower sections 51*a*, 51*b*. The upper and intermediate sections 51*a*, 51*c* are provided as one body, while the upper end of the lower mandrel section 51*b* is connected to the lower end of the intermediate mandrel section 51*c*, for example by means of a threaded connection. The lower end of the lower mandrel section 51*b* comprises a connection interface 51*d* for connection to a drill pipe section.

The outer housing 53 comprises a lower housing section 53*a* and an upper housing section 53*b* provided radially outside at least a part of the intermediate mandrel section 51*c*, The outer housing 53 is fixed to the mandrel 51.

A slips device 70 is provided radially outside the inner mandrel 51 and axially between the lower and upper housing sections 53*a*, 53*b*, In the run state in FIG. 3, the outer surface of the slips device 70 is aligned with the outer surface of the housing sections 53*a*, 53*b*, i.e. the slips device 70 is radially retracted. In the set state in FIG. 4, the slips device 70 is radially protruding from the housing sections 53*a*, 53*b*, i.e. slips device 70 is radially expanded.

The slips device 70 is supported by upper and lower slips supports 71, 72 in the run state and in the set state. The upper slips support 71 is fixed to the intermediate mandrel section 51*c* and to the upper housing section 52*a*. The lower slips support 72 is axially displaceable in relation to the mandrel 51 and hence, also in relation to the housing 53. As shown in FIGS. 3 and 4, the lower slips support 72 is connected between the mandrel and the lower housing section 53*b*.

The anchor module 50 further comprises a fluid actuation system 60 generally indicated by two arrows in FIGS. 3 and 4. The fluid actuation system 60 comprises a lower piston 62 and an upper piston 63 provided in lower and upper fluid chambers 64, 65 respectively.

The lower fluid chamber 64 is provided radially between the intermediate mandrel section 51*c* and the lower housing section 53*b* and axially between the lower housing section 53*b*, the lower mandrel section 51*b* and the lower piston 62. In the present embodiment, the lower piston 62 is formed by the lower slips support 72 itself. As shown in FIGS. 3 and 4, a piston surface 62*a* is indicated on the surface of the lower slips support 72 facing towards the lower piston chamber 64. However, it should be noted that the lower piston 62 and the lower slips support 72 could be provided as separate bodies connected to each other.

The lower fluid chamber 64 is provided in fluid communication with the bore 52 by means of a lower fluid line 66 provided radially through the intermediate mandrel section 51*c*. The entrance from the bore 52 into the lower fluid line 66 is referred to as reference number 66*a*.

The lower piston 62 is axially displaceable within the lower fluid chamber 64. The movement of the lower piston 62 within the lower fluid chamber 64 will be described further in detail below.

The upper fluid chamber 65 is provided radially between the intermediate mandrel section 51*c* and the upper housing section 53*a* and axially between the upper housing section 53*b* and the upper slips supporting device 71. As shown in FIGS. 3 and 4, a piston surface 63*a* is indicated on the surface of the upper piston 63 facing towards the upper piston chamber 65. The upper piston 63 is connected to the lower slips device 72 by means of an axial rod 74. Hence, when the upper piston 63 is moved upwardly (i.e. from the position in FIG. 3 to the position in FIG. 4), the lower slips supporting device 72 is also moved upwardly (i.e. to the left in the drawings), thereby causing the slips device 70 to be moved from its run state to its set state. Oppositely, when the upper piston 63 is moved downwardly (i.e. from the position in FIG. 4 to the position in FIG. 3), the lower slips supporting device 72 is also moved downwardly (i.e. to the right in the drawings), thereby causing the slips device 70 to be moved from its set state to its run state.

The upper fluid chamber 65 is provided in fluid communication with the bore 52 by means of a upper fluid line 67 provided radially through the intermediate mandrel section 51*c*. The entrance from the bore 52 into the upper fluid line 67 is referred to as reference number 67*a*.

The fluid actuation system 60 further comprises a fluid restriction 68 provided in the bore 52. In the present embodiment, the fluid restriction 68 is a pipe section inserted into the bore 52 of the upper mandrel section 51*a* and/or the intermediate mandrel section 51*c*. Alternatively, the fluid restriction may be a part of the mandrel device 51 itself. Accordingly, the cross sectional area of the fluid bore 52 at the entrance 67*a* of the upper fluid line 67 is lower than the cross sectional area of the fluid bore 52 at the entrance 66*a* of the lower fluid line 66. The fluid restriction 68 is configured to provide a lower fluid pressure in the fluid bore 52 at the entrance 66*a* of the lower fluid line 66 than the fluid pressure in the fluid bore 52 at the entrance 67*a* of the upper fluid line 67.

A spring device 73 is provided radially outside of the inner mandrel 51 and radially inside of the outer housing 53. In the present embodiment, the spring device 73 is provided in the upper housing section 53*a*, more specifically, in the upper piston chamber 65. The purpose of the spring device 73 is to force the slips device 70 to the run state. Hence, the slips device 70 can be viewed as biased to its run state by means of the spring device 73. The purpose of the fluid actuation system 60 is to counteract the biasing force provided by the spring device 73. Consequently, the fluid actuation system 60 is causing the slips device 70 to move from its run state to its set state when actuated.

Preferably, the area of a lower piston surface 62*a* of the lower piston 62 is similar to, or equal to the area of an upper piston surface 63*a* of the upper piston 63.

The anchor module 50 further comprises a further fluid restriction 80 in the bore 52 at a distance from and below the lower fluid line 66. The anchor module 50 comprises an bore expansion 82 at a distance from and below the further fluid restriction 80. Between the further fluid restriction 80 and the bore expansion 82, the bore 52 comprises a fluid port 81 providing fluid communication between the outside of the anchor module 50 and the bore 52.

The function of the anchor module 50 will now be described with reference to FIGS. 3 and 4. Initially, no fluid is supplied to the bore 52, and hence, the fluid actuation system 60 is not actuated. Accordingly, the lower slips supporting device 62 is forced downwardly by means of the spring device 73 via the rod 74, and the slips device 70 is in the run state shown in FIG. 3.

A connection interface 59 in the upper end of the anchor module 50 is connected to the upper drill pipe section via the other modules 10, 20, 30 of the casing plug CP, as described above and the casing plug CP is lowered into the well. At the desired location, fluid is pumped down through the bore 3 and hence also to through the bore 52 of the anchor module 50. At a certain fluid rate, the pressure differential generated by the fluid restriction 68 causes the fluid pressure inside the fluid restriction 68 to decrease, due to the smaller cross sectional area A67 of the bore 52 at the entrance 67*a* of the upper fluid line 67 to the upper fluid chamber 65, which is sufficient to counteract the spring device 73. Hence, the pressure in the fluid bore 52 at the entrance 67*a* of the upper fluid line 67 and hence also in the upper fluid chamber 65 will decrease. The cross sectional area A67 is smaller than the cross sectional area A66 of the bore 52 at the entrance 66*a* of the lower fluid line 66 to the lower fluid chamber 64.

As the cross sectional area A66 is larger than the cross sectional area A67, and as the areas of the lower piston surface 62*a* and the upper piston surface 63*a* being equal to each other, an increase in the fluid flow through the bore 52 to a fluid flow above a certain fluid flow threshold will cause a fluid force acting on the lower piston surface 62*a* which will counteract the force acting on the lower piston 62 via the axial rod 74. As described above, the fluid pressure in the lower fluid chamber will apply a force to the lower piston in an upward direction, while the axial rod will apply a force to the lower piston in a downward direction. The force acting on the lower piston 62 via the axial rod 74 is caused both by the fluid pressure acting on the upper piston surface 63*a* and the force applied to the upper piston 63 by the spring device 73. Hence, as the lower slips support 72 is moved towards the upper slips support 71, the slips device 70 will be moved from the run state in FIG. 3 to the set state in FIG. 4.

According to the above description, it is achieved that the anchor module 50 is set by means of a difference in fluid pressure at different locations in the bore 52, that is the fluid pressure at the location of the upper fluid line 67 and the fluid pressure at the location of the lower fluid line 66. Hence, the anchor module 50 is set independent of the fluid pressure outside of the anchor module 50, which is a parameter which normally can not be controlled from topside of the tool string.

Hence, one disadvantage of the prior art SSCP is overcome. Moreover, it should be emphasized that even if the anchor module is set by means of a difference in fluid pressure at different locations in the bore 52, this difference is achieved by controlling the fluid rate topside of the tool string, not by controlling the fluid pressure topside of the tool string.

It should be noted that the inner diameter of the fluid restriction 78 is denoted as D1, and that this inner diameter is equal to the diameter of the bore 52 at the entrance 67*a* of the fluid line 67 between the bore 52 and the upper fluid chamber 65.

It is now referred to FIGS. 5 and 6. Here a further anchor module 50 is shown in its run and set state respectively. As the anchor module 50 of FIGS. 5 and 6 is mostly identical to the anchor module of FIGS. 3 and 4, the anchor module 50 of FIGS. 5 and 6 will not be described here in detail. However, the difference between these anchor modules 50 will be described. The only difference between these anchor modules are the inner diameter of the fluid restriction 78 is different. In FIGS. 5 and 6, the inner diameter of the fluid restriction 78 is denoted as D2, and when comparing FIGS. 3 and 4 with FIGS. 5 and 6, it is clearly shown that the diameter D2 is smaller than the diameter D1. Consequently, the fluid rate threshold for setting the anchor module 50 of FIGS. 5 and 6 is different from the fluid rate threshold for setting the anchor module 50 of FIGS. 3 and 4. More specifically, the fluid rate threshold for setting the anchor module 50 of FIGS. 5 and 6 is lower than the fluid rate threshold for setting the anchor module 50 of FIGS. 3 and 4.

The upper anchor module 50 is configured to be set in the casing C by pumping a fluid at an initial fluid rate through the bore 52 and the lower anchor module 50 is configured to be set in the casing C by pumping a fluid at a further fluid rate through the bore 52, where the initial fluid rate is less than the further fluid rate.

Figures 7A, 7B, 7C, 7D, 7E:
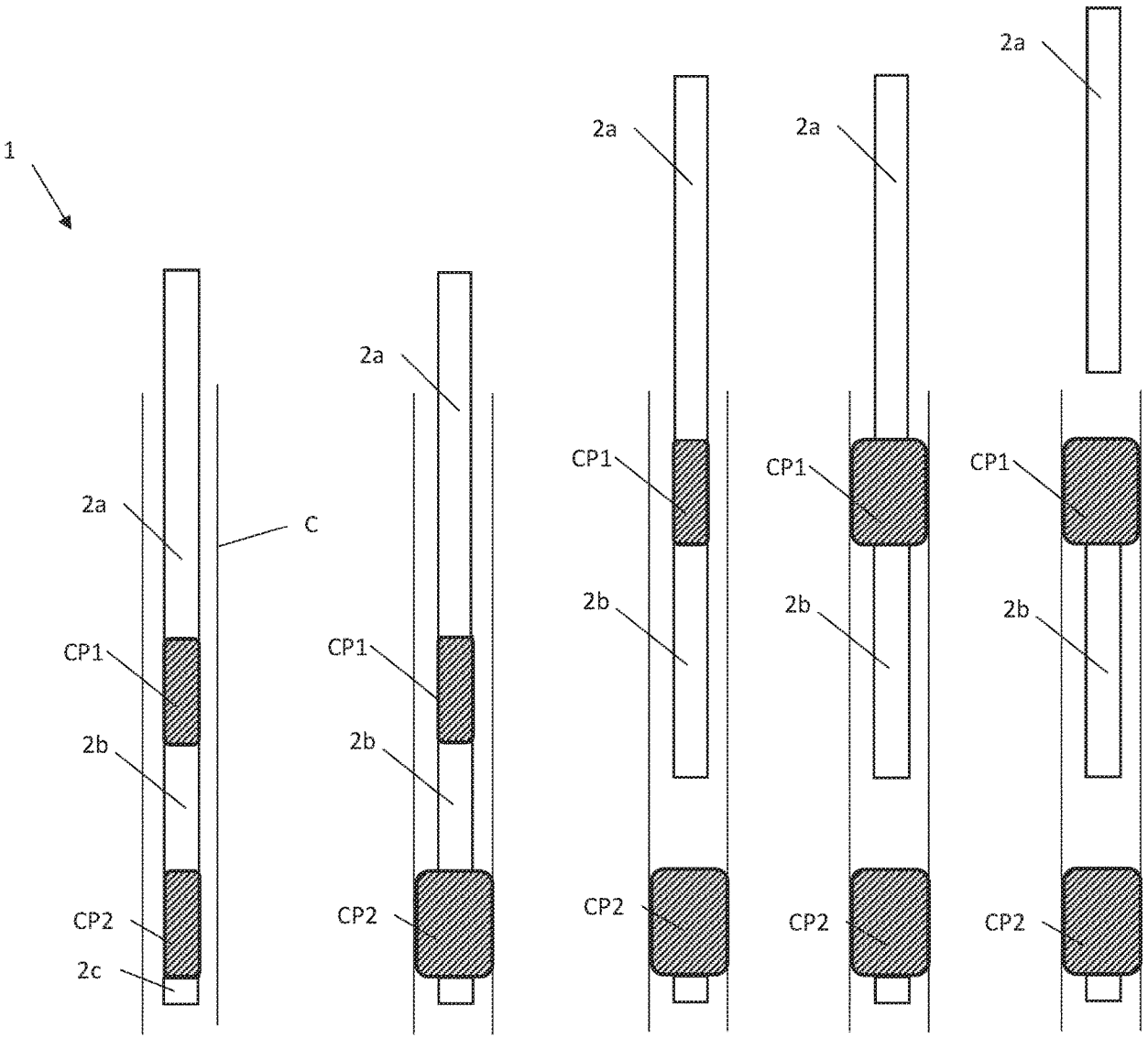

It is now referred to FIG. 7*a-e*. In FIG. 7*a*, a casing plug assembly 1 is shown lowered into a casing C. The casing plug assembly 1 comprises an upper drill pipe section 2*a*, an upper casing plug CP1 connected below the upper drill pipe section 2*a*, an intermediate drill pipe section 2*b* connected below the upper casing plug CP1 and a lower casing plug CP2 connected below the intermediate drill pipe section 2*b*. In addition, a lower drill pipe section 2*c* may be connected to the lower casing plug CP2.

The upper casing plug CP1 is a casing plug as shown and described with reference to FIG. 2 above, where the anchor module 50 of the upper casing plug CP1 is of the type shown in FIGS. 3 and 4, i.e. with a fluid restriction having a diameter D1.

The lower casing plug CP2 is also a casing plug as shown and described with reference to FIG. 2 above, where the anchor module 50 of the lower casing plug CP is of the type shown in FIGS. 5 and 6, i.e. with a fluid restriction having a diameter D2.

Hence, both the upper and lower casing plugs CP1, CP2 comprises upper and lower running modules 10, upper and lower seal modules 30 and upper and lower anchor modules 50 respectively.

As described above, the casing plug assembly 1 comprises is a continuous through bore 3 provided through the upper drill pipe section 2*a*, the upper casing plug CP1, the intermediate drill pipe section 2*b* and further through the lower casing plug CP2 and the lower drill pipe section 2*c*.

In a first step, shown in FIG. 7*a*, the casing plug assembly 1 is run into the well to the desired location by means of the drill string connected to the upper drill pipe section 2*a* of the assembly 1.

Then, a fluid is pumped through the drill string and the through bore 3 of the assembly 1 at an initial fluid rate sufficient to set the lower anchor module 50 of the lower casing plug CP2 in the casing. As described above, the upper anchor module 50 of the upper casing plug CP1 will also be set at this initial fluid rate.

When the lower anchor module 50 is set, the lower seal module 30 is set in the casing by applying an axial force to the drill string against the set lower anchor module 50. The set lower casing plug CP2 is illustrated in FIG. 7*b*.

Then, the lower casing plug CP2 is disconnecting from the intermediate drill pipe section 2*b* of the assembly 1. The upper casing plug CP1 is then moved to its desired location in the casing. This is illustrated in FIG. 7*c*.

Then, a fluid is pumped though the drill string and the through bore 3 at a further or second rate sufficient to set the upper anchor module 50 in the casing.

When the upper anchor module 50 is set, the upper seal module 30 is set in the casing by applying an axial force to the drill string against the set upper anchor module 50. This is shown in FIG. 7*d*.

In a final step, the upper casing plug CP1 is disconnected from the upper drill pipe section 2*a*, as shown in FIG. 7*d*. The upper drill pipe section 2*a* together with the drill pipe may now be retrieved from the well.

A double barrier has now been established in the casing in one run.

It should be noted that in the description above, the setting of the respective seal modules 30, the disconnection of the respective casing plugs from the drill pipe sections etc, is considered known for a skilled person, for example from NO 20150683.

The invention claimed is:

1. An anchor module for anchoring to a casing, comprising:

an inner mandrel having a through bore;

a slips device provided radially outside the inner mandrel;

upper and lower slips supports for supporting the slips device in a run state, in which the slips device is radially retracted, and for supporting the slips device in a set state, in which the slips device is radially expanded;

a spring device provided radially outside of the inner mandrel, wherein the slips device is biased to the run state by means of the spring device;

a fluid actuation system configured to counteract the biasing force provided by the spring device, thereby causing the slips device to move from the run state to the set state;

wherein the fluid actuation system comprises a lower piston axially displaceable within a lower fluid chamber, wherein a lower fluid line is provided between the through bore and the lower fluid chamber, wherein the lower piston is a part of or is connected to the lower slips device;

wherein the fluid actuation system further comprises an upper piston axially displaceable within an upper fluid chamber, wherein an upper fluid line is provided between the through bore and the upper fluid chamber, wherein the upper piston is connected to the lower slips device;

wherein the fluid actuation system further comprises a fluid restriction provided in the through bore, wherein a cross sectional area of the through bore at the entrance of the upper fluid line is smaller than the cross sectional area of the through bore at the entrance of the lower fluid line.

2. The anchor module according to claim 1, wherein the anchor module comprises an outer housing comprising a lower housing section and an upper housing section provided radially outside at least a section of the inner mandrel, wherein the lower fluid chamber is provided inside the lower housing section and wherein the upper fluid chamber is provided inside the upper housing section.

3. The anchor module according to claim 2, wherein the spring device is provided in the upper fluid chamber.

4. The anchor module according to claim 3, wherein the upper piston is connected to the lower slips device by means of an axial rod.

5. The anchor module claim 4, wherein the area of a lower piston surface of the lower piston is equal to the area of an upper piston surface of the upper piston.

6. The anchor module according to claim 5, wherein the fluid actuation system is configured to be supplied with a fluid via the through bore.

7. The anchor module according to claim 6, wherein the lower piston surface of the lower piston is a part of the lower slips device.

8. The anchor module according to claim 1, wherein the spring device is provided in the upper fluid chamber.

9. The anchor module according to claim 1, wherein the upper piston is connected to the lower slips device by means of an axial rod.

10. The anchor module according to claim 1, wherein the area of a lower piston surface of the lower piston is equal to the area of an upper piston surface of the upper piston.

11. The anchor module according to claim 1, wherein the fluid actuation system is configured to be supplied with a fluid via the through bore.

12. The anchor module according to claim 1, wherein the lower piston surface of the lower piston is a part of the lower slips device.

13. A casing plug assembly for providing a double barrier in a casing, comprising:

an upper drill pipe section;

an upper casing plug connected below the upper drill pipe section;

wherein the upper casing plug comprises an upper running module, an upper seal module, and an upper anchor module;

wherein a continuous through bore is provided through the upper drill pipe section and the upper casing plug;

wherein the upper anchor module is configured to be set in the casing by pumping a first fluid at a first fluid rate through the continuous through bore;

wherein the casing plug assembly further comprises:

an intermediate drill pipe section connected below the upper casing plug;

a lower casing plug connected below the intermediate drill pipe section;

wherein the lower casing plug comprises a lower running module, a lower seal module, and a lower anchor module;

wherein the continuous through bore is provided through the intermediate drill pipe section and the lower casing plug;

wherein the lower anchor module is configured to be set in the casing by pumping a second fluid at a second fluid rate through the continuous through bore;

wherein the second fluid rate is less than the first fluid rate, wherein:

the upper anchor module is an anchor module for anchoring to the casing, comprising:

an inner mandrel having a through bore;

a slips device provided radially outside the inner mandrel;

upper and lower slips supports for supporting the slips device in a run state, in which the slips device is radially retracted when in the run state, and for supporting the slips device in a set state, in which the slips device is radially expanded when in the set state;

a spring device provided radially outside of the inner mandrel, wherein the slips device is biased to the run state by means of the spring device;

a fluid actuation system configured to counteract the biasing force provided by the spring device, thereby causing the slips device to move from the run state to the set state;

wherein the fluid actuation system comprises a lower piston axially displaceable within a lower fluid chamber, wherein a lower fluid line is provided between the through bore and the lower fluid chamber, wherein the lower piston is a part of or is connected to the lower slips device;

wherein the fluid actuation system further comprises an upper piston axially displaceable within an upper fluid chamber, wherein an upper fluid line is provided between the through bore and the upper fluid chamber, wherein the upper piston is connected to the lower slips device;

wherein the fluid actuation system further comprises a fluid restriction provided in the through bore, wherein a cross sectional area of the through bore at the entrance of the upper fluid line is smaller than the cross sectional area of the through bore at the entrance of the lower fluid line, wherein the fluid restriction of the upper anchor module has a first diameter;

the lower anchor module is an anchor module comprising a same structure as the upper anchor module, wherein the fluid restriction of the lower anchor module has a second diameter;

the second diameter is smaller than the first diameter.

14. The casing plug assembly according to claim 13, wherein the lower casing plug is configured to be released from the intermediate drill pipe section before the upper casing plug is set.

15. A method for providing the double barrier in the casing, comprising:

a) running the casing plug assembly according to claim 14 to a desired location in the casing by means of a drill string connected to the upper drill pipe section of the assembly;

b) pumping the first fluid through the drill string and the continuous through bore of the assembly at the first fluid rate sufficient to set the lower anchor module in the casing;

c) setting the lower seal module in the casing by applying a first axial force to the drill string against the set lower anchor module;

d) disconnecting the lower casing plug from the intermediate drill pipe section of the assembly;

e) moving the upper casing plug to another desired location in the casing;

f) pumping the second fluid through the drill string and the continuous through bore of the assembly at the second fluid rate sufficient to set the upper anchor module in the casing;

g) setting the upper seal module in the casing by applying a second axial force to the drill string against the set upper anchor module;

h) disconnecting the upper casing plug from the upper drill pipe section from the assembly.

16. A method for providing the double barrier in the casing, comprising:

a) running the casing plug assembly according to claim 13 to a desired location in the casing by means of a drill string connected to the upper drill pipe section of the assembly;

b) pumping the first fluid through the drill string and the continuous through bore of the assembly at the first fluid rate sufficient to set the lower anchor module in the casing;

c) setting the lower seal module in the casing by applying a first axial force to the drill string against the set lower anchor module;

d) disconnecting the lower casing plug from the intermediate drill pipe section of the assembly;

e) moving the upper casing plug to another desired location in the casing;

f) pumping the second fluid through the drill string and the continuous through bore of the assembly at the second fluid rate sufficient to set the upper anchor module in the casing;

g) setting the upper seal module in the casing by applying a second axial force to the drill string against the set upper anchor module;

h) disconnecting the upper casing plug from the upper drill pipe section from the assembly.

17. The casing plug assembly according to claim 13, wherein the lower casing plug is configured to be released from the intermediate drill pipe section before the upper casing plug is set.

18. A method for providing the double barrier in the casing, comprising:

a) running the casing plug assembly according to claim 17 to a desired location in the casing by means of a drill string connected to the upper drill pipe section of the assembly;

b) pumping the first fluid through the drill string and the continuous through bore of the assembly at the first fluid rate sufficient to set the lower anchor module in the casing;

c) setting the lower seal module in the casing by applying a first axial force to the drill string against the set lower anchor module;

d) disconnecting the lower casing plug from the intermediate drill pipe section of the assembly;

e) moving the upper casing plug to another desired location in the casing;

f) pumping the second fluid through the drill string and the continuous through bore of the assembly at the second fluid rate sufficient to set the upper anchor module in the casing;

g) setting the upper seal module in the casing by applying a second axial force to the drill string against the set upper anchor module;

h) disconnecting the upper casing plug from the upper drill pipe section from the assembly.

19. A method for providing the double barrier in the casing, comprising:

a) running the casing plug assembly according to claim 13 to a desired location in the casing by means of a drill string connected to the upper drill pipe section of the assembly;

b) pumping the first fluid through the drill string and the continuous through bore of the assembly at the first fluid rate sufficient to set the lower anchor module in the casing;

c) setting the lower seal module in the casing by applying a first axial force to the drill string against the set lower anchor module;

d) disconnecting the lower casing plug from the intermediate drill pipe section of the assembly;

e) moving the upper casing plug to another desired location in the casing;

f) pumping the second fluid through the drill string and the continuous through bore of the assembly at the second fluid rate sufficient to set the upper anchor module in the casing;

g) setting the upper seal module in the casing by applying a second axial force to the drill string against the set upper anchor module;

h) disconnecting the upper casing plug from the upper drill pipe section from the assembly.

* * * * *